US008784221B1

(12) United States Patent
Bishop

(10) Patent No.: US 8,784,221 B1
(45) Date of Patent: Jul. 22, 2014

(54) OCCUPANT PROPELLED ROUNDABOUT

(71) Applicant: Michael Bishop, Brockton, MA (US)

(72) Inventor: Michael Bishop, Brockton, MA (US)

( * ) Notice: Subject to any disclaimer, the term of this patent is extended or adjusted under 35 U.S.C. 154(b) by 48 days.

(21) Appl. No.: 13/688,507

(22) Filed: Nov. 29, 2012

Related U.S. Application Data

(63) Continuation-in-part of application No. 12/874,384, filed on Sep. 2, 2010, now Pat. No. 8,342,975.

(51) Int. Cl.
*A63G 1/22* (2006.01)
*A63G 1/12* (2006.01)

(52) U.S. Cl.
USPC ..... 472/21; 472/26

(58) Field of Classification Search
USPC ..... 472/4, 5, 14, 19–24, 26, 108
See application file for complete search history.

(56) References Cited

U.S. PATENT DOCUMENTS 708,540 A * 9/1902 Felton ..... 472/26
832,459 A 10/1906 Cruz
1,534,894 A * 4/1925 Beebe ..... 472/14
3,672,669 A 6/1972 Ottaviano
3,858,871 A 1/1975 Bourne
4,428,576 A 1/1984 Fisher, Jr.
D287,262 S 12/1986 McNutt et al.
5,011,133 A 4/1991 Myers, Sr.
5,246,400 A 9/1993 Klucik
5,607,359 A 3/1997 Farmer, Sr.

* cited by examiner

*Primary Examiner* — Kien Nguyen
(74) *Attorney, Agent, or Firm* — Goldstein Law Offices, P.C.

(57) ABSTRACT

One embodiment of an occupant propelled roundabout ("roundabout") may have a body. The roundabout may also have a carrier, which may be rotatably carried by the body and may also have a seat assembly adapted to carry an occupant. In addition, the roundabout may also have a drive mechanism pivotally coupled to the seat assembly such that the drive mechanism may be movable between a deployed position and a retracted position. The drive mechanism may be moved toward the deployed position in response to the occupant operating the drive mechanism. Also, the roundabout may have a biasing member, which may be operably connected between the drive mechanism and the carrier so that the biasing member may move the drive mechanism toward the retracted position.

8 Claims, 9 Drawing Sheets

OCCUPANT PROPELLED ROUNDABOUT

CROSS-REFERENCE TO RELATED APPLICATIONS

This application is a continuation-in-part utility application of the nonprovisional patent application Ser. No. 12/874,384 filed in the United States Patent Office on Sep. 2, 2010 and claims the priority thereof and is expressly incorporated herein by reference in its entirety.

FIELD OF THE DISCLOSURE

The present disclosure generally relates to amusement devices, and more particularly to an occupant propelled roundabout having a drive mechanism that is movable between a deployed position and a retracted position.

BACKGROUND OF THE DISCLOSURE

Because of our desire to be entertained, thrilled, and stimulated, a wide variety of amusement devices, rides, and vehicles have been created. Such devices exist both in public settings such as amusement parks, municipal parks, and schools—and in private settings such as backyard swing-sets and "jungle gyms", etc. A key element in all such devices is providing an experience of fun for the user, whether they are a child, an adolescent, or an adult. The most classic forms of such devices provide the thrill of motion, including from see-saws, merry-go-rounds, swings, slides, and the like. Perhaps the most popular of these are self-propelled—since they place the user in charge of the intensity of the ride they experience.

Early occupant propelled amusement devices required an operator to continuously move those devices at a desired speed while he or she and any other occupants may enjoy the ride. One example of these devices may include a bicycle driven merry-go-round, which may have a center post, a platform rotatably carried by the center post and one or more bicycles secured to the platform. In use, an operator may operate the bicycle thereby spinning the platform about the center post and permitting occupants on the platform to enjoy the ride. The bicycles may spin the platform provided that the operators continuously operate their respective bicycles because the rolling friction associated with the bicycles may quickly decelerate the platform when the operators elect to cruise rather than pedal.

Most recent merry-go-rounds do not use the bicycles and require an individual to run alongside the platform to push it until it reaches a desired speed and then jump onto the platform to enjoy the ride along with other occupants on the platform. However, it may require more energy to spin these merry-go-rounds as compared to the predecessor merry-go-rounds that included bicycles. In addition, it may be somewhat difficult to board the platform after pushing it to spin at a generally high speed.

SUMMARY OF THE INVENTION

One embodiment of an occupant propelled roundabout ("roundabout") may have a body. The roundabout may also have a carrier, which may be rotatably carried by the body and may also have a seat assembly adapted to carry an occupant. In addition, the roundabout may also have a drive mechanism pivotally coupled to the seat assembly such that the drive mechanism may be movable between a deployed position and a retracted position. The drive mechanism may be moved toward the deployed position in response to the occupant operating the drive mechanism. Also, the roundabout may have a biasing member, which may be operably connected between the drive mechanism and the carrier so that the biasing member may move the drive mechanism toward the retracted position.

Another embodiment of a roundabout may have a body that may include a base. In addition, the body may also include a post extending from the base. The roundabout may also have a carrier, which may include a cross bar rotatably carried by the post. The carrier may also have a first pillar carried by one end of the cross bar and a second pillar carried by the other end of the cross bar. Furthermore, the carrier may have a first seat assembly, which may be carried by the first pillar and may also be adapted to carry a first occupant. The roundabout may also have a first drive mechanism, which may be pivotally coupled to the first seat assembly and may be movable between a deployed position and a retracted position. The first drive mechanism may be moved toward the deployed position in response to the first occupant operating the first drive mechanism. The roundabout may also have a first biasing member that may be operably connected between the first drive mechanism and the carrier. The first biasing member may move the first drive mechanism toward its retracted position. Also, the carrier may have a second seat assembly, which may be carried by the second pillar and may also be adapted to carry a second occupant. The roundabout may also have a second drive mechanism, which may be pivotally coupled to the second seat assembly and may also be movable between a deployed position and a retracted position. The second drive mechanism may be moved toward the deployed position in response to the second occupant operating the second drive mechanism. The roundabout may also have a second biasing member that may be operably connected between the second drive mechanism and the carrier. The second biasing member may move the second drive mechanism toward its retracted position.

Another embodiment of the roundabout may include, for each seat assembly, a T-bar secured to the cross bar. The T-bar having a front and rear. The seating assembly having a horizontal support having a front and rear. A vertical post secures the front of the seat assembly to the front of the T-bar. A chain support may extend between the rear of the T-bar and rear of the seat assembly. In addition, the biasing member may be a spring that is secured between the rear of the horizontal support and the drive assembly, for biasing the drive assembly toward its retracted position.

One embodiment of a method for operating an occupant propelled roundabout may include supporting an occupant on a seat assembly. The method may also include operating a drive mechanism pivotally carried by the seat assembly, such that the drive mechanism moves toward a deployed position and a wheel of the drive mechanism accelerates the roundabout with respect to the ground. In addition, the method may include disengaging the drive mechanism such that a biasing member moves the drive mechanism toward a retracted position.

BRIEF DESCRIPTION OF THE DRAWINGS

The advantages and features of the present disclosure will become better understood with reference to the following detailed description and claims taken in conjunction with the accompanying drawing, in which:

Like reference numerals refer to like parts throughout the description of several views of the drawings.

DETAILED DESCRIPTION OF THE DISCLOSURE

Figure 1:
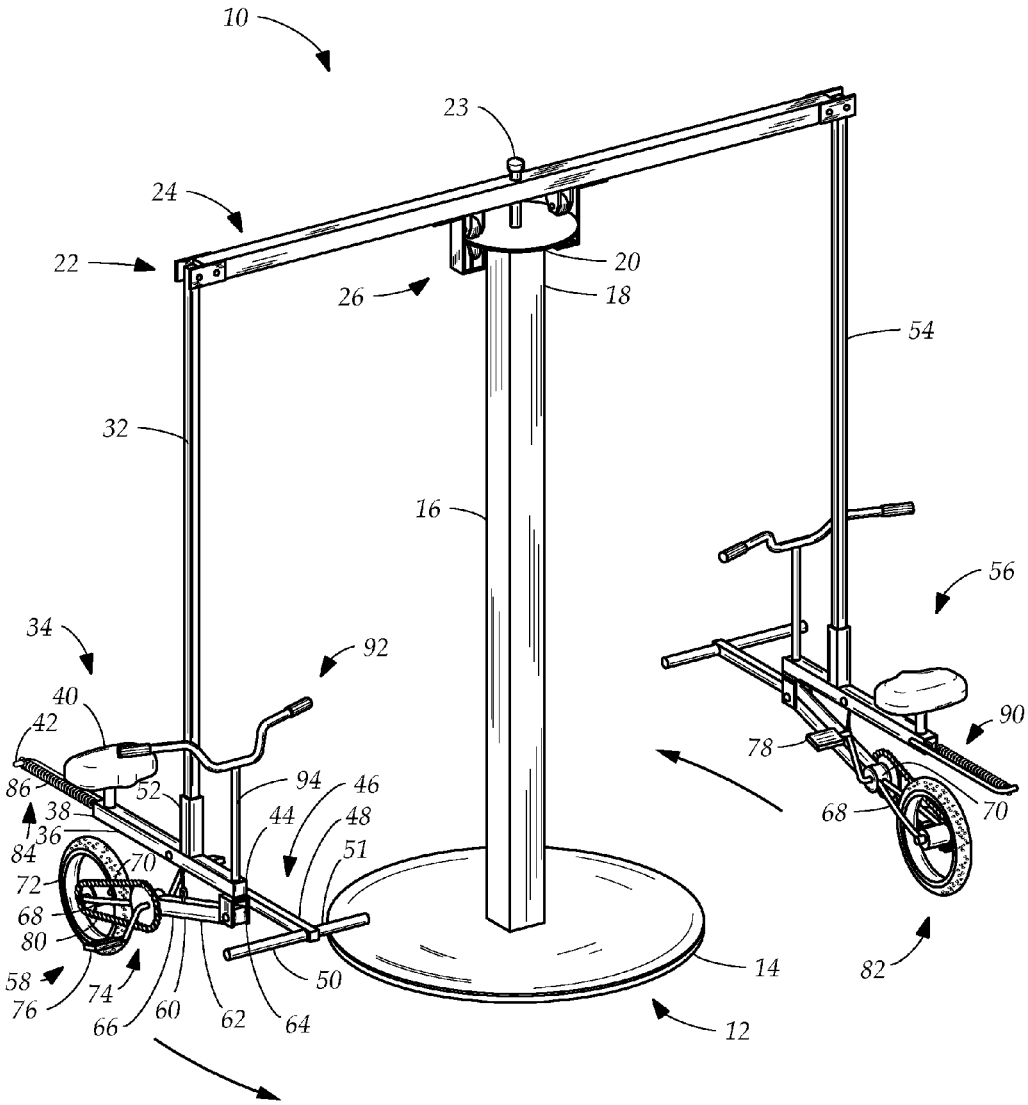
FIG. 1 is a perspective view of one embodiment of an occupant propelled roundabout having a pair of seat assemblies, a pair of drive mechanisms and a pair of biasing members.

FIG. 1 illustrates an occupant propelled roundabout 10 ("roundabout") having a body 12, which in this form may be a central spindle member including a base 14. The base 14 may be a generally flat disc. Of course, the base may instead be other suitable foundations, such as a series of legs extending radially outward from a common hub or center, a concrete footing, or any other anchoring system. The body 12 has a central post 16 extending upwardly from the base 14. The central post 16 in one form may be a hollow tube that terminates at an end 18 with an annular flange 20 or round plate. The post, however, may be other support structures that may include, for example, a central frame including an outer periphery having a circuitous track.

Figure 2:
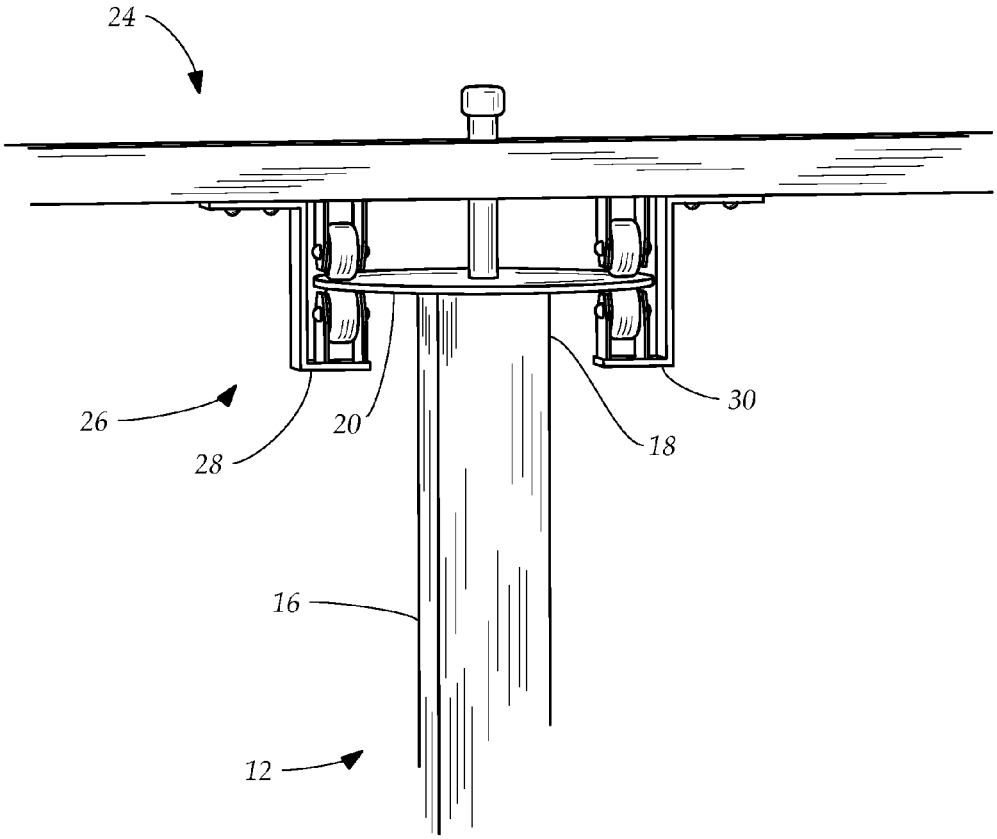
FIG. 2 is an enlarged view of one embodiment of a bearing assembly for the roundabout of FIG. 1.
Figure 3A:
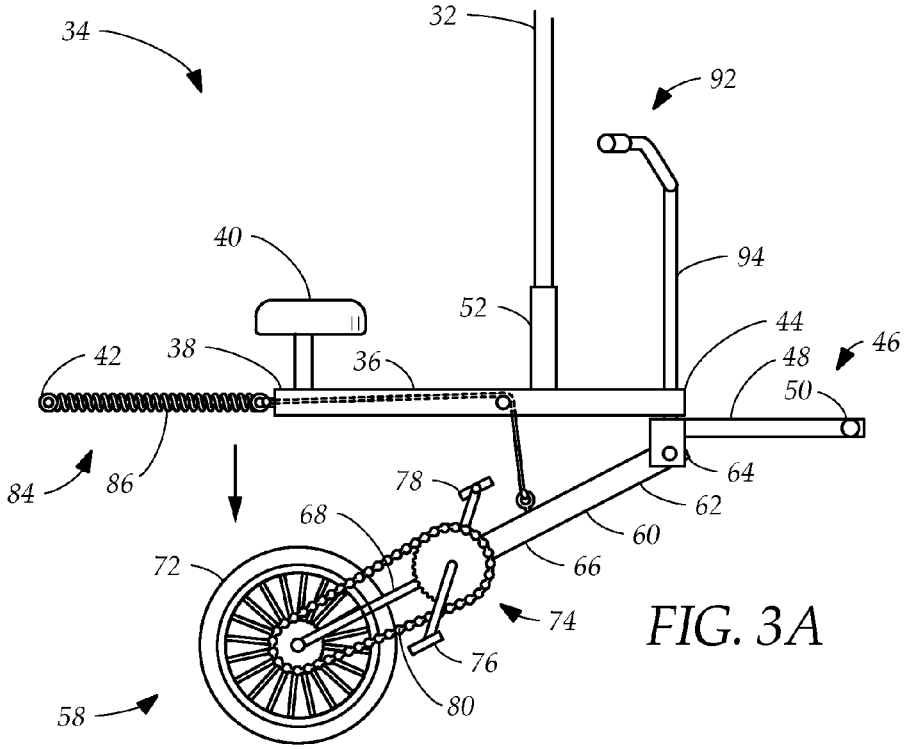
FIG. 3A is a side view of the roundabout of FIG. 1, showing one of the drive mechanisms moved to a deployed position with respect to one of the seat assemblies.
Figure 3B:
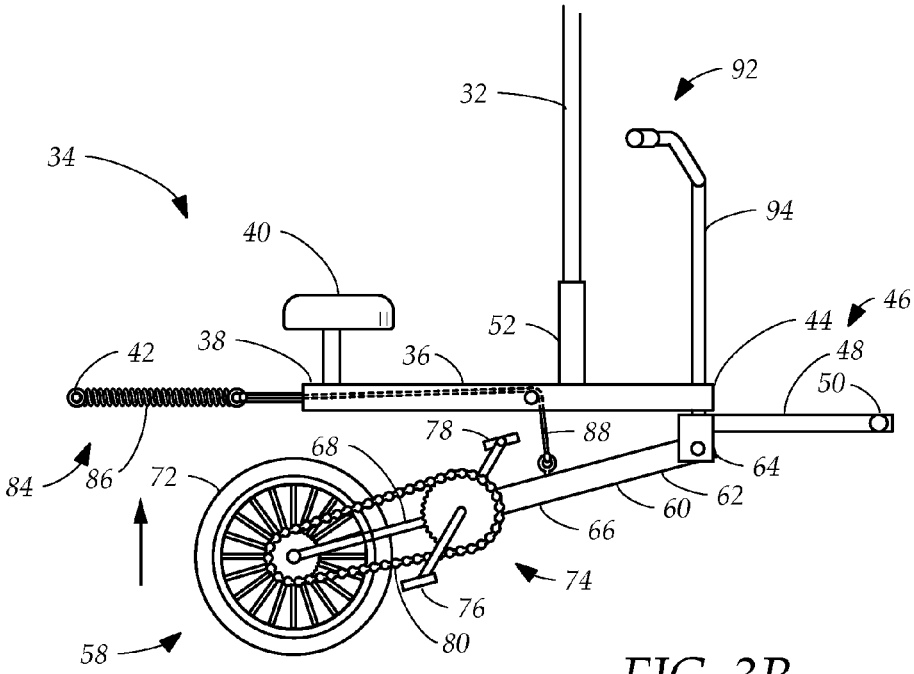
FIG. 3B is a side view of the roundabout of FIG. 3A, showing the drive mechanism moved to a retracted position with respect to the seat assembly.

Referring to FIG. 1, the roundabout 10 may also have a carrier 22 rotatably carried by the central post 16 by, for example, a center pin 23 or bolt member. The carrier 22 in this form may include a cross bar 24 and a bearing assembly 26 (FIG. 2) that may be carried by a central portion of the cross bar 24. The bearing assembly 26 may have a first pair of roller bearings 28 that may sandwich the annular flange 20 therebetween and a second pair of roller bearings 30 that may sandwich the annular flange 20 therebetween. As best shown in FIGS. 1, 3A and 3B, the carrier 22 may also have a first pillar 32 pivotally carried by one end of the cross bar 24. As best shown in FIGS. 3A and 3B, the carrier 22 may also have a first seat assembly 34, which may be carried by the first pillar 32 and may be adapted to carry a first occupant. The first seat assembly 34 in this form may include a tube 36 having a rear portion 38. The first seat assembly 34 may also have a seat 40 carried by the rear portion 38 of the tube 36. Furthermore, the first seat assembly 34 may have an anchor member 42 carried by the rear portion 38 of the tube 36. The anchor member 42 in this form may be a rod extending from the rear portion 38 of the tube 36. In addition, the first seat assembly 34 may also have a front portion 44 opposite the rear portion 38 and a pedestal 46 carried by the front portion 44 to support feet of the first occupant. The pedestal 46 in this form may be a leg 48 or bar that may extend from the front portion 44 of the tube 36 and terminate with a pair of pegs 50, 51 extending diametrically therefrom. The first seat assembly 34 may also have a socket 52 that may be communicated with tube 36 and extend perpendicular therefrom. The socket 52 may receive a portion of the first pillar 32 and may be fastened thereto. As shown in FIG. 1, the carrier 22 may also have a second pillar 54 that may be pivotally carried by another end of the cross bar 24 opposite the first pillar 32. The second pillar 54 may be similar to the first pillar 32. In addition, the carrier 22 may also have a second seat assembly 56, which may be carried by the second pillar 54 and may be adapted to carry a second occupant. The second seat assembly 56 may be similar to the first seat assembly 34.

Referring to FIGS. 3A and 3B, the roundabout 10 may also have a first drive mechanism 58 that may be pivotally coupled to the first seat assembly 34. The first drive mechanism 58 may be movable between a deployed position (FIG. 3A) and a retracted position (FIG. 3B), with the first drive mechanism 58 being moved toward the deployed position in response to the first occupant operating the first drive mechanism 58. The first drive mechanism 58 in this form may include an arm 60 pivotally carried by any suitable portion of the carrier 22. For example, the arm 60 may be a post 62 having a first end 64 pivotally carried by the front portion 44 of the first seat assembly 34. The post 62 may have a second end 66 opposite the first end 64. The arm 60 may also include a pair of chainstays 68, 70 extending from the second end 66 of the post 62. In addition, the first drive mechanism 58 may also have a wheel 72 that may be rotatably carried by the chainstays 68, 70 or other portions of the arm 60. In addition, the first drive mechanism 58 may also have a sprocket assembly 74 that may be rotatably carried by the second end 66 of the post 62 or any suitable portion of the arm 60. The sprocket assembly 74 may also include a pair of pedals 76, 78, such that the first drive mechanism 58 may be moved to the deployed position in response to the first occupant operating the pair of pedals 76, 78. The first drive mechanism 58 may also have a chain 80 operably interconnecting the sprocket assembly 74 and the wheel 72 such that the wheel 72 rotates in response to the first occupant operating the pair of pedals 76, 78.

As shown in FIG. 1, the roundabout 10 may also have a second drive mechanism 82 that may be pivotally carried by the second seat assembly 56. The second seat assembly 82 may be similar to the first seat assembly 34.

Referring to FIGS. 3A and 3B, the roundabout 10 may also have a first biasing member 84 that may be operably connected between the first drive mechanism 58 and the carrier 22. The first biasing member 84 in this form may include a helical spring 86 carried by the anchor member 42. The first biasing member 84 may also include a line 88 interconnecting the helical spring 86 and the first drive mechanism 58, such that the helical spring 86 pulls the first drive mechanism 58 toward the retracted position. Of course, the first biasing member may instead have other suitable components that may, for example, include a torsional spring (not shown) interconnecting the first end 64 of the post 62 and the front portion 44 of the first seat assembly 34.

As shown in FIG. 1, the roundabout 10 may also have a second biasing member 90 that may be operably connected between the second drive mechanism 82 and the carrier 22. The second biasing member 90 may be substantially similar to the first biasing member 84.

Figure 4A:
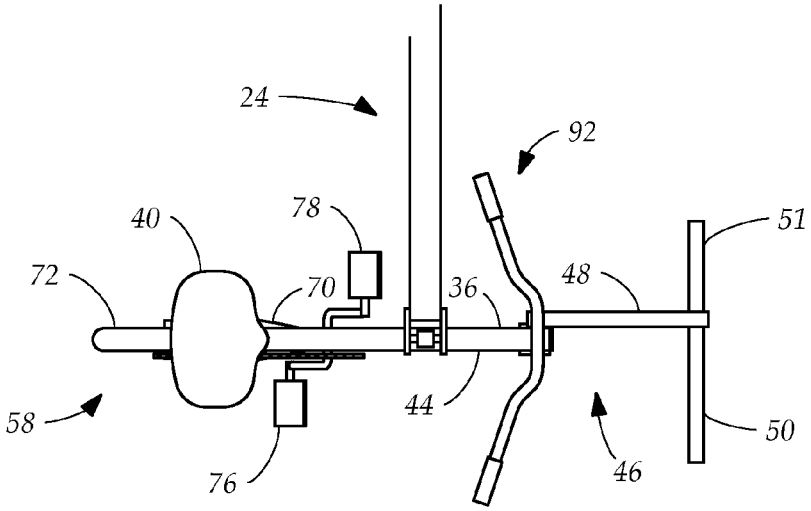
FIG. 4A is a top view of the roundabout of FIG. 1, showing the one of the drive mechanisms moved to a straight position.
Figure 4B:
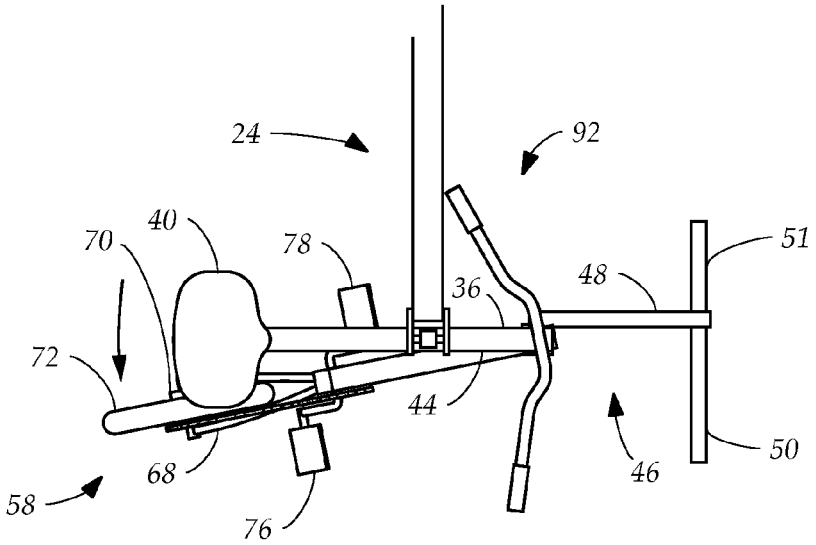
FIG. 4B is a top view of the roundabout of FIG. 4A, showing the drive mechanism moved to a pivoted position.

Referring to FIGS. 1, 4A and 4B, the first seat assembly 34 in this form may also include a handle assembly 92 having a steering post 94 that may be pivotally carried by the front portion 44 of the tube 36 or any other suitable portion of the carrier 22, so that the steering post 94 may pivot about a first axis to direct the wheel 72 a predetermined number of degrees radially inward. In addition, the first drive mechanism 58 in this form may be pivotally carried by the steering post 94. Specifically, the steering post 94 may terminate with a clevis that pivotally carries the post 60 of the first drive mechanism 58 thereby permitting the first drive mechanism 58 to pivot about a second axis that is perpendicular to the first axis. Of course, the first drive mechanism 58 may instead terminate with a clevis that pivotally carries the steering post. In addition, it is also contemplated that the steering post 94 may be carried by the tube in one fixed position and the wheel 72 may have tire tread configured to provide better lateral acceleration in one direction. For example, the tire tread (not shown) may include ridges extending somewhat radially inward from a rear portion of the tread toward a forward portion of the tread.

Figure 5A:
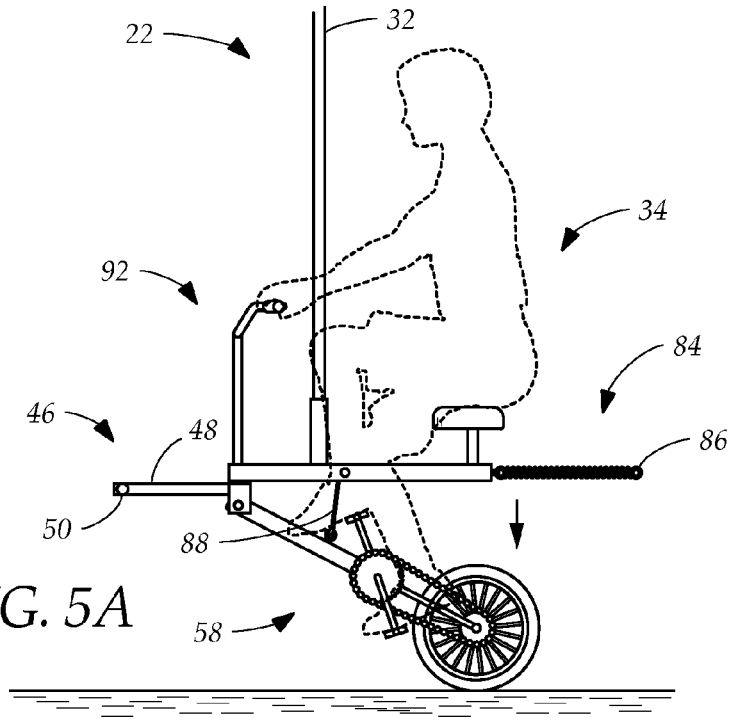
FIG. 5A is a side view of the roundabout of FIG. 1, showing an occupant operating one of the drive mechanisms thereby moving the drive mechanism to its deployed position.
Figure 5B:
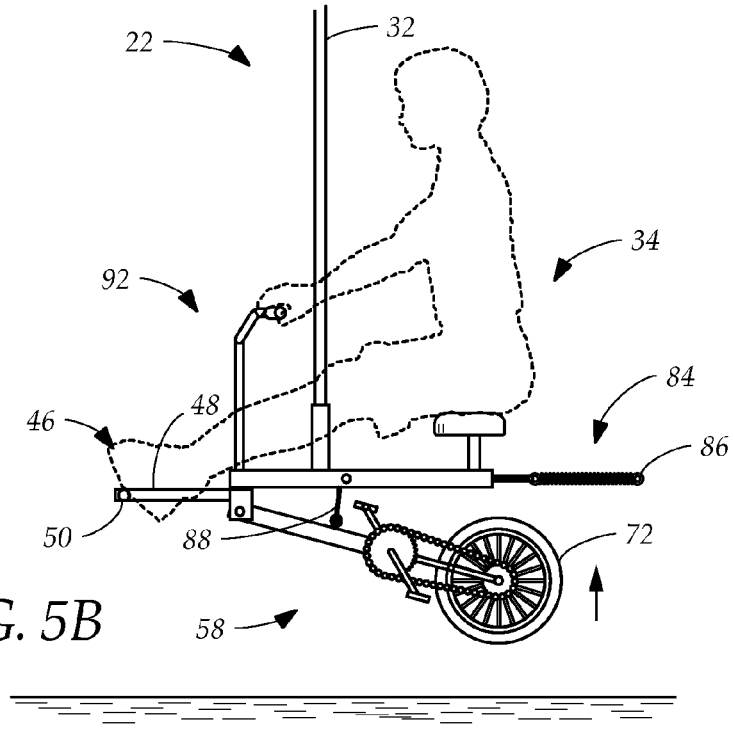
FIG. 5B is a side view of the roundabout of FIG. 5B, showing the occupant resting his or her feet on a pedestal thereby permitting the first biasing member to move the first drive mechanism to its retracted position.

Referring now to FIGS. 1, 5A and 5B, one embodiment of a method for operating the roundabout 10 may include supporting two occupants on seats 40 of a respective one of the first and second seat assemblies 34, 56. As shown in FIG. 5A, the first occupant may operate the first drive mechanism 58 by, for example, operating the pedals 76, 78 with his or her feet while applying slight downward pressure to overcome the bias of the biasing members 84, 90. The first drive mechanism 58 may move toward its deployed position and the wheel 72 may accelerate the roundabout 10 with respect to the ground, in response to the first occupant operating the first drive mechanism 58. In so doing, the helical spring 86 may stretch toward an elongated position in response to the first drive mechanism 58 moving to its deployed position. The method may also include pivoting the handle assembly 92 radially inward with respect to a circular path of the seat assemblies thereby pivoting the first drive mechanism 58 radially inward to provide better traction of the wheel 72 at generally higher speeds and reduce any skidding. The method may also include disengaging the first drive mechanism 58 when, for example, the roundabout 10 is spinning at a desired speed. For example, the first occupant may move his or her feet from the pedals 76, 78 to the pedestal 46. Accordingly, the first biasing member 84 may move the first drive mechanism 58 toward its retracted position (FIG. 5B) above the ground thereby eliminating rolling friction of the first drive mechanism 58 and increasing the length of time in which the roundabout 10 may spin. In so doing, the helical spring 86 may return toward its original non-elongated position in response to the occupant disengaging the first drive mechanism 58. The second occupant on the second seat assembly 56 may operate and disengage the second drive mechanism 84 in a similar manner as the first occupant operates and disengages the first drive mechanism 58.

Figure 6A:
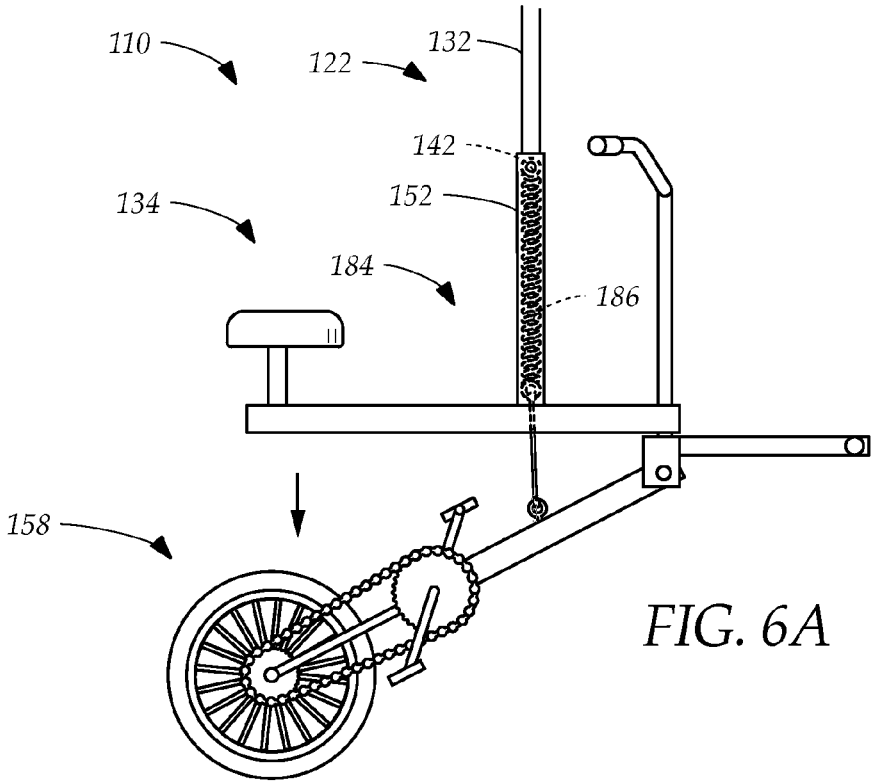
FIG. 6A is a side view of another embodiment of a roundabout, showing the carrier having a drive mechanism moved to a deployed position.
Figure 6B:
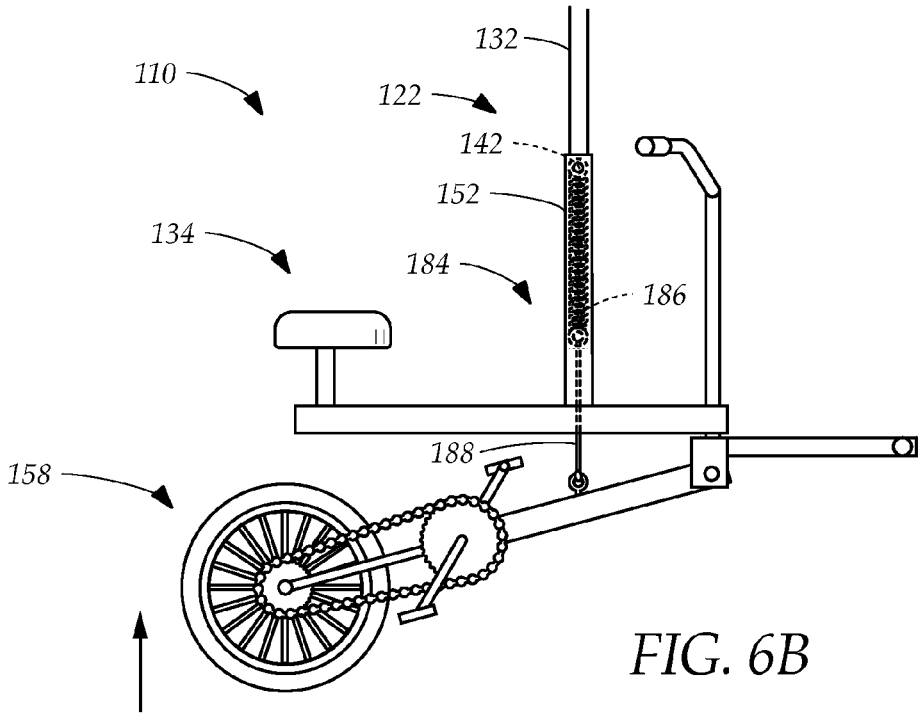
FIG. 6B is a side view of the roundabout of FIG. 6A, showing the drive mechanism moved to a retracted position.

Referring now to FIGS. 6A and 6B, another embodiment of a roundabout 110 may include a carrier 122, a first seat assembly 134, a first drive mechanism 158 and a first biasing member 184. The roundabout 110 may be substantially similar to the roundabout 10 of FIGS. 3A and 3B. However, the carrier 122 may have an anchor member 142 that may be carried by the socket 152 or the first pillar 132, as compared to the anchor member 42 of FIGS. 3A and 3B being carried by the rear portion 38 of the tube 36. In this respect, the first biasing member 184 may have a helical spring 186 that may be disposed or at least partially enclosed within the socket 152 and thereby protected from dust, debris and moisture or condensation. In addition, the roundabout 110 may also have a second seat assembly, a second drive mechanism and a second biasing member that are similar to a respective one of the first seat assembly 134, the first drive mechanism 158 and the first biasing member 184.

Figure 8:
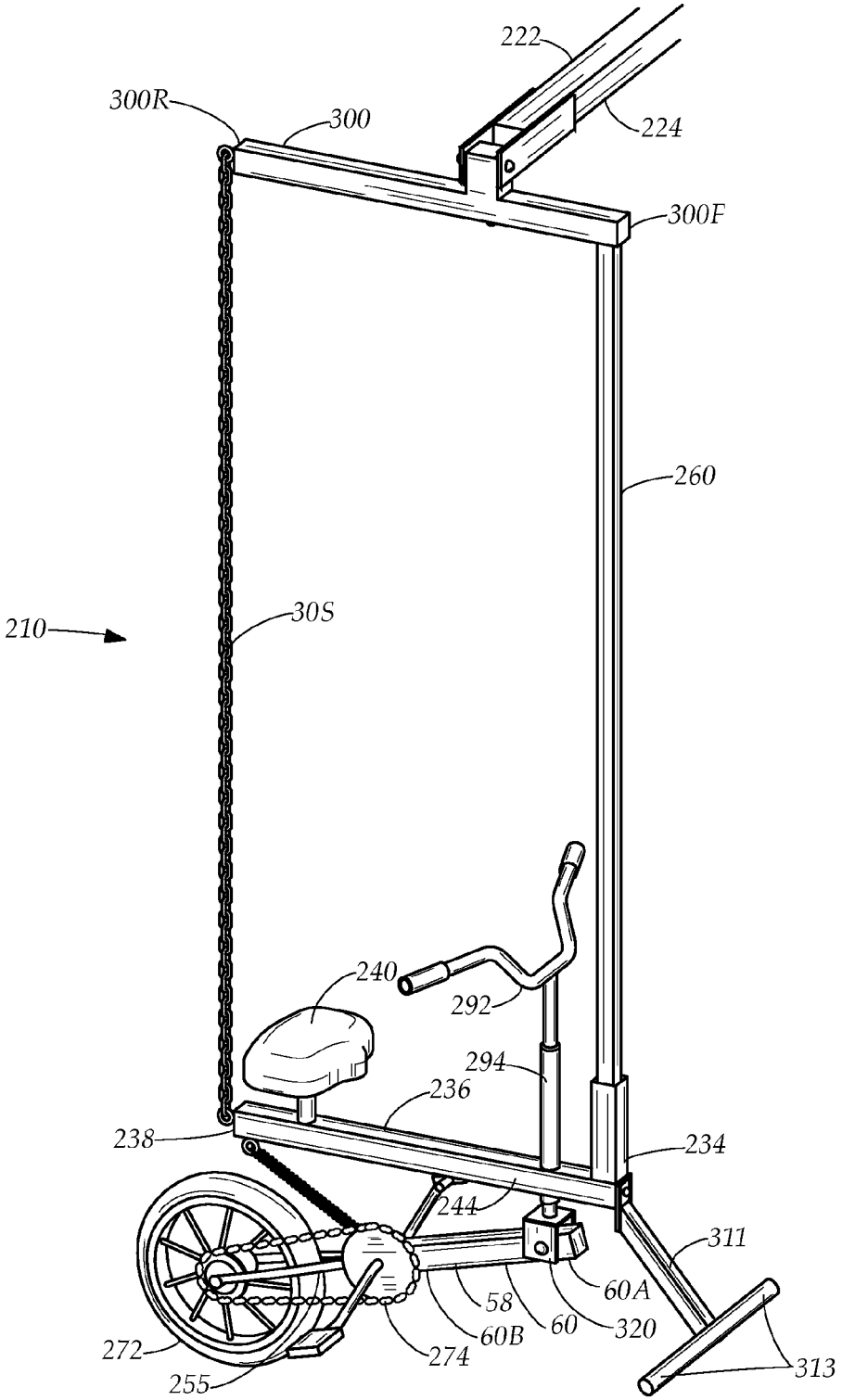
FIG. 8 is a perspective view of the further embodiment of the roundabout as show in FIGS. 7A and 7B, showing the drive mechanism moved to a retracted position.

Referring now to FIG. 8, a further embodiment of a roundabout 210 is illustrated. In particular a carrier 222 includes a seat assembly 234. Note as with the other embodiments, preferably at least two seat assemblies 234 are provided and connected to the carrier 222, for carrying at least two occupants. For simplicity, the features of this embodiment are described without "first" and "second", with the understanding that each of these elements may be employed in the same way in the at least two seat assemblies 134 in previous embodiments. And with regard to the previous discussion of the first two embodiments, where equivalent structures exist on, for example the seat assemblies of each, 34 and 134, "first" and "second" could easily be eliminated, or could be substituted with "pair", or "one of", "the other" or the like.

Figure 7A:
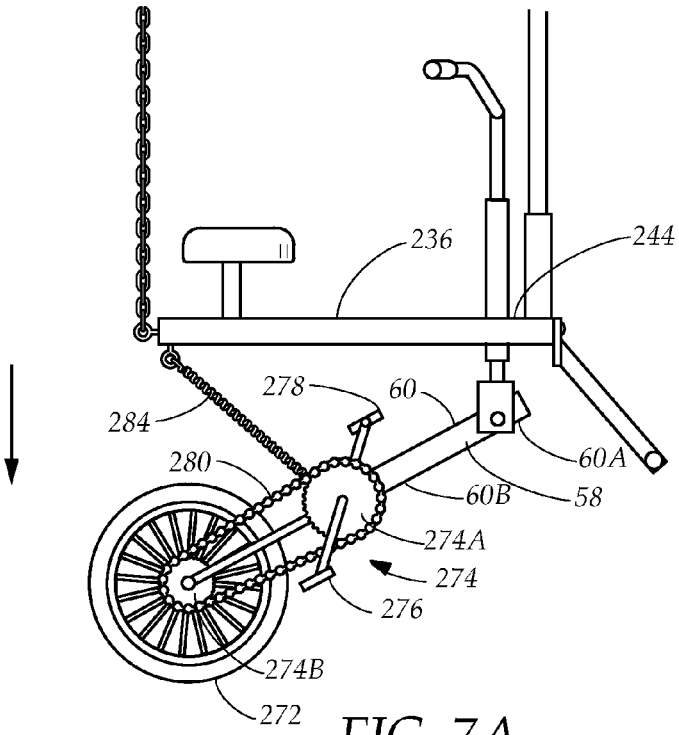
FIG. 7A is a side view of a further embodiment of a roundabout, showing the carrier having a drive mechanism moved to a deployed position.

Referring still to FIG. 8, the seat assembly 234 includes a horizontal support tube 236, having a front 244 and a rear 238. The seat assembly 234 includes a drive mechanism 58 that includes an arm 60 having a first end 60A and a second end 60B. A wheel support 255 extends rearwardly from the second end 60B of the arm 60. A wheel 272 is attached on the wheel support. Referring to FIG. 7A, a sprocket assembly 274 is located at the second end 60B of the arm 60, and includes a first sprocket 274A, with a pair of pedals 276, 278 coaxially mounted thereon, and a second sprocket 274B coaxially mounted to the wheel 272. The sprockets 274A, 274B are mechanically linked by a chain 280, for allowing the user to rotate the wheel 272 by pedaling—in particular by the user engaging the pedals 276, 278 and rotating the first sprocket 274A. The first end 60A of the arm 60 is pivotally attached near the front 244 of the horizontal support tube 236, allowing the drive mechanism 58 to pivot between an extended position and a retracted position. In the extended position, the wheel 272 is in contact with a ground surface beneath the roundabout 210. In the retracted position, the wheel is not in contact with said ground surface.

Figure 9:
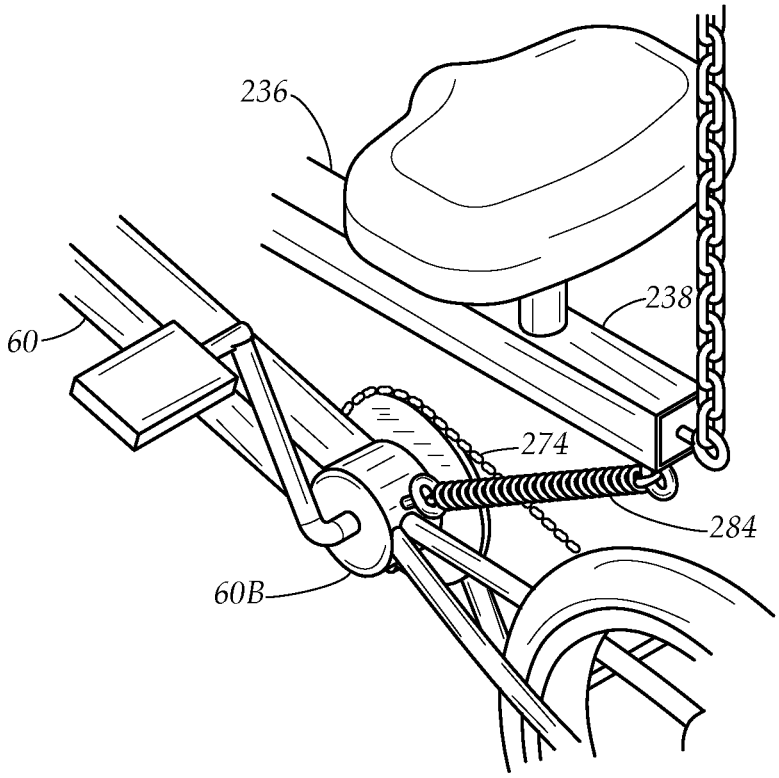
FIG. 9 is a diagrammatic perspective view of the further embodiment, showing interconnection between the drive mechanism and the horizontal support.

According to this further embodiment as shown in FIG. 8, a biasing member 284, preferably a spring, is attached between the rear 238 of the horizontal support tube 236 and the second end 60B of the arm. Referring momentarily to FIG. 9, the biasing member is preferably attached to the second end 60B of the arm 60 immediately adjacent to the sprocket assembly 274.

Also illustrated in FIG. 8, the roundabout 210 includes a T-bar 300 which is secured to a carrier 222 which includes cross bar 224, which is similar to the cross bar 24 of the first embodiment, and may be connected to a post and base, similar to the post 16 and base 14 illustrated in FIG. 1. The T-bar 300 includes a front 300F and a rear 300R, and is secured by a pivoting hinge to the cross bar 224 between the front 300F and rear 300R. The T-bar 300 may be connected to the seat assembly 234 by a vertical post 260 at the front 244 of the horizontal support tube 236 and at the front 300F of the T-bar; and by a support chain 30S at the rear 300R of the T-bar 300 and rear 238 of the horizontal support tube 236. Note that the support chain 30S provides additional support and rigidity for the seat assembly by supporting the horizontal support tube at both its front and rear.

A seat 240 is secured atop the horizontal support tube 236 near its rear 238, forwardly of the chain 30S. A handle assembly 292 includes a handle post 294 that extends upwardly through the support tube 236 near its front 244, but located rearwardly of the vertical post 260. The handle post 29 is hingedly connected to the drive mechanism and the handle assembly slidably extends through the handle post 294 so that the user can steer the drive mechanism with the handle assembly as well as allow the drive mechanism with the attached sprocket and pedal assembly to move up and down.

A pedestal 311, includes a pair of foot pegs 313, and is secured at the front 244 of the horizontal support tube 236. In a further embodiment, the pedestal includes an internal spring and the pedestal is spring-loaded to the seat assembly 234.

Figure 7B:
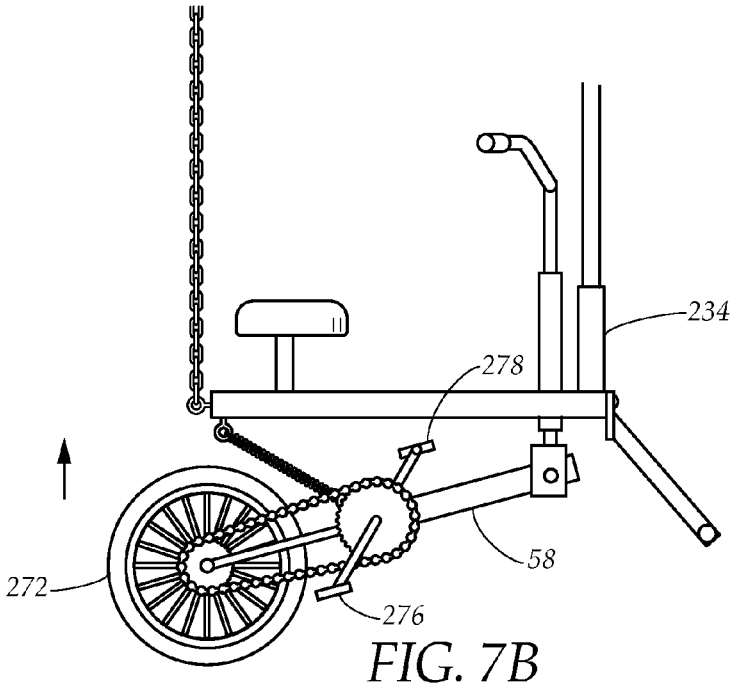
FIG. 7B is a side view of the roundabout of FIG. 6A, showing the drive mechanism moved to a retracted position.

Referring now to FIGS. 7A and 7B, when it is desired to accelerate, an occupant seated upon the seat engages the pedals 276, 278 with feet, applying downward pressure, as indicated in FIG. 7A, to overcome the bias of the biasing member, moving the drive assembly downwardly until the wheel 272 contacts a ground surface beneath the wheel. Then by pedaling, the seat assembly 234 and the roundabout 210 is propelled until a desired speed is reached. Once the desired speed is reached, the occupant relieves downward pressure by the feet through the pedals, allowing the drive assembly to retract upwardly. The occupant may then place the feet upon the pegs of the pedestal to allow the roundabout to coast, until it is desired to accelerate again, whereupon the occupant reengages the pedals.

The exemplary embodiments described herein detail for illustrative purposes are subject to many variations in structure and design. It should be emphasized, however, that the present disclosure is not limited to an occupant propelled roundabout having two seat assemblies, two drive mechanisms and two biasing members as shown and described. For example, the roundabout may instead have three or more of the aforementioned components such that three or more occupants may operate the roundabout. Conversely, the roundabout may have only one of each aforementioned component with the second components being replaced by a counterweight mechanism such that the roundabout may be operated by only one occupant. It is understood that various omissions and substitutions of equivalents are contemplated as circumstances may suggest or render expedient, but these are intended to cover the application or implementation without departing from the spirit or scope of the claims of the present disclosure. Also, it is to be understood that the phraseology and terminology used herein is for the purpose of description and should not be regarded as limiting.

The foregoing descriptions of specific embodiments of the present disclosure have been presented for purposes of illustration and description. They are not intended to be exhaustive or to limit the present disclosure to the precise forms disclosed, and obviously many modifications and variations are possible in light of the above teaching. The embodiments were chosen and described in order to best explain the principles of the present disclosure and its practical application, to thereby enable others skilled in the art to best utilize the present disclosure and various embodiments with various modifications as are suited to the particular use contemplated. It is understood that various omission and substitutions of equivalents are contemplated as circumstance may suggest or render expedient, but such are intended to cover the application or implementation without departing from the spirit or scope of the claims of the present disclosure.

What is claimed is:

1. An occupant propelled roundabout, comprising:

a body including a central post and a base, the central post extending upwardly from the base;

a carrier secured to the central post for rotation thereupon, the carrier including a cross bar;

at least one seat assembly, including a seat for supporting an occupant, the seat assembly supported beneath the cross bar and spaced from the central post thereby;

a drive mechanism associated with each of the at least one seat assembly, the drive mechanism having a wheel, and pedals linked to the wheel for allowing the occupant to drive the wheel and move the seat assembly in a circular path around the central post, each drive mechanism movable between a deployed position wherein the wheel engages the ground surface, and a retracted position wherein the wheel is raised above the ground surface.

2. The occupant propelled roundabout as recited in claim 1, further comprising a biasing member, for biasing the drive mechanism toward the retracted position.

3. The occupant propelled roundabout as recited in claim 2, wherein the seat assembly includes a horizontal support tube having a front and rear, and wherein a vertical post is secured to the horizontal support tube and to the cross bar to support the seat assembly.

4. The occupant propelled roundabout as recited in claim 3, wherein the drive assembly includes an arm having a first end and a second end, the pedals are located near the second end, and the first end is pivotally attached near the front of the horizontal support bar.

5. The occupant propelled roundabout as recited in claim 4, wherein the biasing member of each seat assembly is secured between the second end of the arm and rear of the horizontal support tube.

6. The occupant propelled roundabout as recited in claim 5, further comprising a T-bar associated with each seat assembly and secured to the cross bar, having a front and rear, wherein each seat assembly further has a vertical post secured between the front of the horizontal support and the front the T-bar.

7. The occupant propelled roundabout as recited in claim 6, wherein each seat assembly has a support chain extending between the rear of the horizontal support and the rear of its associated T-bar.

8. The occupant propelled roundabout as recited in claim 7, wherein each seat assembly has a handle assembly, including a post secured to the horizontal bar rearwardly of its associated vertical post.

* * * * *